United States Patent [19]

Yamada et al.

[11] 4,352,763

[45] Oct. 5, 1982

[54] VENT CHANGEOVER DEVICE FOR A CARBURETOR

[75] Inventors: Nobuo Yamada, Kariya; Toshiharu Morino, Mie, both of Japan

[73] Assignee: Aisan Industry Co., Ltd., Aichi, Japan

[21] Appl. No.: 310,541

[22] Filed: Oct. 13, 1981

Related U.S. Application Data

[63] Continuation of Ser. No. 137,157, Apr. 4, 1980, abandoned.

[30] Foreign Application Priority Data

Apr. 27, 1979 [JP] Japan ..... 54/57490

[51] Int. Cl.[3] ..... F02M 5/08

[52] U.S. Cl. ..... 261/72 R; 261/DIG. 67; 137/871

[58] Field of Search ..... 261/DIG. 67, 72 R; 137/871

[56] References Cited

U.S. PATENT DOCUMENTS

| | | | |
|---|---|---|---|
| 2,530,942 | 11/1950 | Drow | 137/871 |
| 2,771,282 | 11/1956 | Olson et al. | 261/DIG. 67 |
| 3,093,124 | 6/1963 | Wentworth | 261/DIG. 67 |
| 3,273,871 | 9/1966 | Winkler | 261/DIG. 67 |
| 3,460,522 | 8/1969 | Kittler et al. | 261/DIG. 67 |
| 3,548,797 | 12/1970 | Hagihara et al. | 261/DIG. 67 |
| 4,157,366 | 6/1979 | Ruth et al. | 261/DIG. 67 |
| 4,181,154 | 1/1980 | Oley et al. | 137/871 |

FOREIGN PATENT DOCUMENTS

| | | | |
|---|---|---|---|
| 611796 | 10/1960 | Italy | 261/DIG. 67 |

*Primary Examiner*—Tim R. Miles

[57] ABSTRACT

A vent changeover device for carburetors comprising two working ends provided on a piston rod of a piston moving in a suction chamber, one of which constitutes a rod end of the piston and the other of which constitutes an angle member joined to an end portion of the piston rod, an inner valve being actuated by the angle member so as to open and close an inner vent, an outer valve being actuated by the rod end so as to open and close an outer vent and disposed so as to face in a direction opposite to the direction in which the inner valve faces, and springs biasing the inner and outer valves, respectively, in vent-closing directions, the vents communicating with the fuel bowl via the respective valves, the inner and outer valves being adapted to be actuated in accordance with the movement of the piston rod such that when one of the valves is opened, the other is closed, the inner vent being opened only when the engine is rotated, and the outer vent being opened only when the engine is stopped.

5 Claims, 1 Drawing Figure

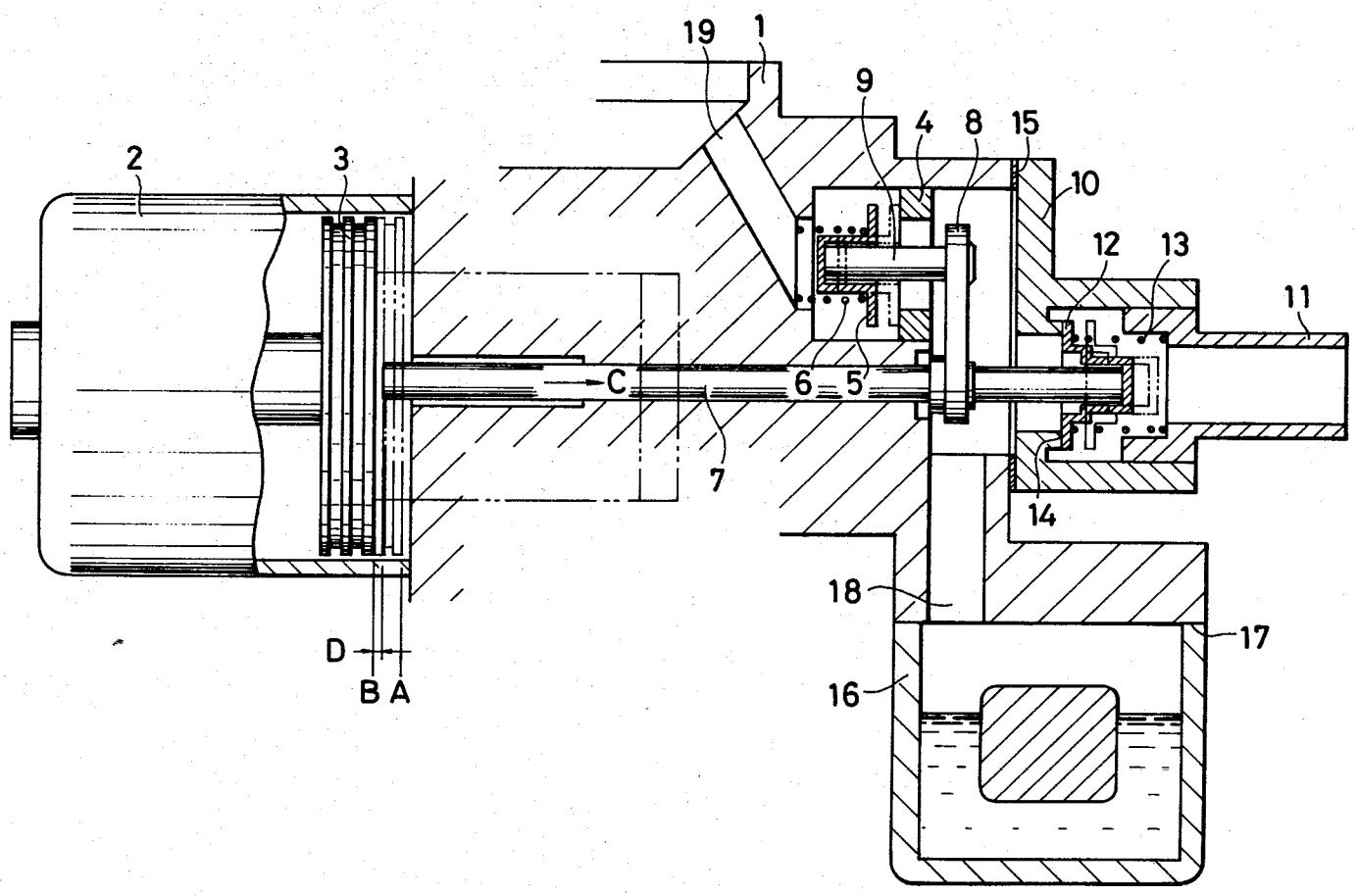
11
13
12
10
15
8
4
9
1
19
17
14
5
6
7
18
16
C
3
2
A
B
D

VENT CHANGEOVER DEVICE FOR A CARBURETOR

This is a continuation of application Ser. No. 137,157 filed Apr. 4, 1980, now abandoned.

BACKGROUND OF THE INVENTION

This invention relates to a vent changeover device for a carburetor. In conventional carburetors, the changeover valves are actuated either by a diaphragm to which is applied a negative pressure, or by a solenoid. In either type of carburetor, it is very difficult to perfectly change over the vent. Moreover, the conventional vent changeover devices are expensive.

SUMMARY OF THE INVENTION

An object of this invention is to provide a vent changeover device which overcomes the above-mentioned drawbacks and which comprises a vent changeover device for carburetors comprising two working ends provided on a piston rod 7 of a piston 3 moving in a suction chamber, one of which constitutes a rod end of said piston and the other of which constitutes an angle member 9, 8 joined to an end portion of said piston rod, and inner valve 5 being actuated by said angle member so as to open and close an inner vent 19, an outer valve 12 being actuated by said rod end so as to open and close an outer vent 11 and disposed so as to face in a direction opposite to the direction in which said inner valve 5 faces, and springs 6 and 13 biasing the inner and outer valves 5 and 12, respectively, in vent-closing directions, the vents operatively communicating with a fuel bowl via the respective valves, said inner and outer valves being adapted to the actuated in accordance with the movement of said piston rod such that when one of said valves is opened, the other is closed, said inner vent 19 being opened only when the engine is rotated, and said outer vent 11 being opened only when the engine is stopped.

BRIEF DESCRIPTION OF THE DRAWING

The accompanying drawing shows a cross-sectional view of a preferred embodiment of this invention.

DESCRIPTION OF THE PREFERRED EMBODIMENT

The present invention will now be described with reference to the accompanying drawing.

Secured to the body 1 is a suction chamber 2 which has a piston 3 slidably disposed therein. An inner valve 5 is pressed by the inner valve return spring 6 against the inner valve seat 4 which is secured to the body 1. A rod 7 is inserted through the body 1 in such a manner as to be slidable to the left or right and has a lever 8 secured thereto. A push pin 9 is rigidly connected to the lever 8 (together forming an angle member) so that it moves with the rod 7. The push pin 9 is also fitted into the inner valve 5 thereby centering the valve with respect to the seat 4. Secured to the cover 10 is a pipe 11, on the inner side of which an outer valve return spring 13 is disposed so as to press an outer valve 12 against an outer valve seat 14. One end of the rod 7 is inserted into the outer valve 12. A cover 10 is mounted onto the body 1 with a gasket 15 interposed therebetween. A float chamber 16 is mounted to the body 1 through a gasket 17. An evaporated fuel passage 18 communicates with the float chamber 16 and exhausts via the inner valve 5, when open, through an inner vent 19 to the intake manifold.

Now, we will explain the action of this device.

The device shown in the drawing is in the idling condition with the piston 3 positioned at B. The outer valve 12 is pressed against its seat 14 by the force of the outer valve return spring 13. The inner valve 5 is pushed away from the seat 4 by the push pin 9 against the force of the spring 6, as shown in the drawing. It is a necessary condition that the force of the spring 6 be larger than that of the spring 13. The evaporated fuel is supplied to the intake manifold by way of the passage 18 and the inner vent 19. When the engine is stopped, the piston is moved to the position A, so that the rod 7 is pushed in the direction C causing the outer valve 12 to move away from its seat 14. At the same time, the inner valve 5 bears against its seat 4 by the action of the inner valve return spring 6. As a result, the evaporated fuel from the float chamber 16 is conducted through the passage 18 and the pipe 11 into a canister not shown in the drawing.

With this invention which employs the inner and outer valves 5 and 12, a perfect vent changeover is possible. If a complete changeover is not desired, this can be done by removing a clearance D shown in the drawing. The device according to this invention is small in size and simple in construction. Furthermore, this device has the advantage that it has lower cost and higher reliability as compared with the diaphragm or solenoid type vent changeover device.

What is claimed is:

1. A vent change-over device for an engine having a carburetor with a fuel bowl, comprising a body forming an inner vent and an outer vent operatively communicating with said fuel bowl, a suction chamber operatively controlled by the engine, means including a piston moveably mounted in said suction chamber and having a piston rod connected thereto moveably mounted in said body, said piston rod being formed with two working ends adjacent a free end portion thereof, one of said working ends constitutes a rod end of said piston rod and the other of said two working ends constituteds an angle member including a push pin joined to said end portion of said piston rod, said push pin being formed together with said end portion of said piston rod as a unitary structure in parallel therewith and being oriented in a direction opposite to the rod end, an inner valve adjacent said inner vent being operatively connected to and actuated by said push pin so as to open and close said inner vent, respectively, an outer valve adjacent said outer vent being operatively connected to and actuated by said rod end so as to open and close said outer vent, respectively, said outer valve being separate from said inner valve spaced apart therefrom and disposed as as to face in a direction opposite to the direction in which said inner valve faces, first and second spring means for biasing said inner and outer valves, respectively, in vent-closing directions, said inner and outer vents operatively communicating with the fuel bowl via said inner and outer valves, respectively, said inner and outer valves being positioned relative to said push pin and said rod end of said piston rod and said inner and outer vents and cooperating with said first and second spring means, respectively, so as to be actuated alternately in accordance with the movement of said piston rod such that when one of said valves is opened the other of said valves is closed, said first spring means having a biasing force greater than that of said second spring means, and said piston being operatively connected to said suction chamber for movement so as, via said piston rod, to open said inner vent so as to communicate with said float chamber by opening said inner valve only when the engine is running, and to open said outer vent so as to communicate with said float chamber by opening said outer valve only when the engine is stopped, respectively.

2. The vent change-over device for carburetors, as set forth in claim 1, wherein said body is formed with an inner valve seat defining a first opening communicating said inner vent with said float chamber, said push pin extends coaxially through said first opening of said inner valve seat and spaced from said inner valve seat leaving free a passageway between said inner vent and said float chamber, said body includes a cover forming an outer valve seat defining a second opening communicating said outer vent with said first chamber, said rod end extends coaxially through said second opening of said outer valve seat leaving free a passageway between said outer vent and said float chamber, said body forms a first abutment in the inner vent spaced opposite from said inner valve seat, and said cover forms a second abutment in said outer vent spaced opposite from said outer valve seat, said valves each comprise a cylinder closed at only one end, the latter abutting, respectively, a free end of said push pin and a free end of said rod end, said push pin and said rod end have a diameter slightly less than that of said cylinders respectively disposed therein, said cylinders are each formed with a radially outwardly radially directed flange adjacent the open end of the cylinders, respectively, said first and second spring means are compression springs disposed between said first and second abutment means and said flanges of said first and second valves, respectively, for biasing said valves toward said inner and outer valve seats, respectively, said flanges engagingly overlap said valve seats, respectively, closing said passageways in the vent-closing position at cooperating engaging surfaces thereof respectively and have an outer peripherial diameter greater than the diameter of said first and second openings of said valve seats, respectively, and said engaging surface on said first valve seat faces in a direction away from said engaging surface on said second valve seat.

3. The vent change-over device as set forth in claim 2, further comprising a first gasket and a second gasket, said body forms an evaporated fuel passage communicating with said first opening of said inner valve seat, said cover is connected to said body via said first gasket, with said second opening communicating with said evaporated fuel passage, said float chamber is connected to said body via said second gasket in communication with said evaporated fuel passage.

4. The vent change-over device as set forth in claim 3, wherein said angle member further includes a lever rigidly connected perpendicularly to said end portion of said piston rod and to said push pin, said lever is disposed in said evaporated fuel chamber between said inner and outer valve seats, said inner and outer valves are disposed on opposite sides of said inner and outer valve seats, said free ends of said push pin and of said rod end face in opposite directions.

5. The vent change-over device as set forth in claim 1, wherein said piston is adjustable in its stroke in a position relative to said body so that said first and second valve means have a different characteristic of opening and closing.

* * * * *